US007637549B2

(12) United States Patent
Hess

(10) Patent No.: US 7,637,549 B2
(45) Date of Patent: Dec. 29, 2009

(54) LIFTING SLING

(75) Inventor: Ruedi Hess, Tegerfelden (CH)

(73) Assignee: mamutec AG, St. Gallen (CH)

( * ) Notice: Subject to any disclaimer, the term of this patent is extended or adjusted under 35 U.S.C. 154(b) by 0 days.

(21) Appl. No.: 10/497,467

(22) PCT Filed: Dec. 3, 2002

(86) PCT No.: PCT/CH02/00655

§ 371 (c)(1),
(2), (4) Date: Nov. 12, 2004

(87) PCT Pub. No.: WO03/048023

PCT Pub. Date: Jun. 12, 2003

(65) Prior Publication Data

US 2005/0062303 A1 Mar. 24, 2005

(30) Foreign Application Priority Data

Dec. 3, 2001 (CH) ..... 2207/01

(51) Int. Cl.
*B66C 1/12* (2006.01)
*B66C 1/18* (2006.01)

(52) U.S. Cl. ..... 294/74

(58) Field of Classification Search ..... 294/74; 73/862.56

See application file for complete search history.

(56) References Cited

U.S. PATENT DOCUMENTS 2,960,365 A * 11/1960 Meisen ..... 294/74
3,079,192 A * 2/1963 Otley ..... 294/74
3,466,080 A * 9/1969 Norton ..... 294/74
RE26,704 E * 11/1969 Norton ..... 294/74
3,718,945 A * 3/1973 Brindejonc de Treglode . 294/74
4,116,481 A * 9/1978 Raue ..... 294/74
4,124,244 A * 11/1978 Bryant ..... 294/74
4,210,089 A 7/1980 Lindahl
4,421,352 A * 12/1983 Raue et al. ..... 294/74
4,757,719 A * 7/1988 Franke ..... 73/760
4,850,629 A 7/1989 St. Germain
5,727,833 A 3/1998 Coe
6,149,215 A * 11/2000 Balogh et al. ..... 294/74

FOREIGN PATENT DOCUMENTS

DE 20 38 480 A 2/1972
DE 78 27 613 U 1/1979
EP 0 302 818 A 2/1989
JP 09 278343 A 10/1997
RU 2 090 483 C 9/1997

* cited by examiner

*Primary Examiner*—Paul T Chin
(74) *Attorney, Agent, or Firm*—Buchanan Ingersoll & Rooney PC

(57) ABSTRACT

A lifting belt sling for lifting loads is comprised of a tubular structure having at least two chambers whereby forming, as one unit, a chamber tube that is contiguous over the width. Loosely inserted inserts are located inside the at least two chambers and endlessly extend from one end of the chamber tube to the other end thereof. The inserts overlap the ends of the chamber tube so that they form loops at this location, whereby the inserts, when situated in the loop area, are covered by a tube protective means. A protective tube, which surrounds the chamber tube and is formed by different weaves, significantly increases the resistance to abrasion, the resistance to cutting, and the edge strength. The lifting belt sling is designed for loads of up to 100 t.

35 Claims, 4 Drawing Sheets

LIFTING SLING

The invention relates to a lifting belt sling according to claim 1.

BACKGROUND

Round slings are predominantly used in industry, in the building trade and in industry for lifting loads. Lifting belts are used in many ways in the transportation industry and especially in branches of building.

According to U.S. Pat. No. 4,210,089, a round sling is known which includes two chambers, in order thereby to obtain higher strength and improved resistance to abrasion and cutting.

According to U.S. Pat. No. 5,238,278, a textile round sling is known, with additional ribs on the round sling tube, which thereby is to effect an improved cutting and abrasion resistance.

According to U.S. Pat. No. 5,651,572, a round sling is known which includes an additional strand of optical cables, in order to be able to emit a signal when there is a break.

According to U.S. Pat. No. 4,843,807, a method of production of round slings is known, which relates to a rational production of a round sling.

According to U.S. Pat. No. 5,498,047, a lifting belt is known which consists of a woven band, with loops and at least one reinforced edge, which is to protect against premature wear. An additional textile inlay is concerned as the reinforcement.

The following points are disadvantageous in round slings and lifting belts:

Round slings are manufactured from a tube, which normally consists of one chamber, but can also consist of two chambers as in U.S. Pat. No. 4,210,089. Round slings are manufactured from endless yarn strands, which always give a round, endless ring or round tube, which can, however, be designed in their dimension such that they can lift loads of up to 100 t. Since round slings give an endless ring, they cannot easily be passed under a stationary load object.

Lifting belts are manufactured from woven belts, which according to width and thickness can normally lift loads of up to 20 t. Lifting belts are sewn together to form one piece with two-sided loops. This band can be pulled through under a stationary load and suspended with the loops into a load hook on both sides. Since the bands are under strong stress due to the load, they are very susceptible to wear and cuts. It is frequently sought to eliminate this disadvantage with a costly coating.

SUMMARY

The present invention has as its object to propose a lifting belt with which the advantages of round slings are combined with the advantages of lifting belts.

A further object consists of substantially raising the service and use life of the lifting belt loops over those of the conventional lifting belts sewn of belt material and to design them for loads up to 100 t.

This object is attained according to the invention with a lifting belt sling according to the wording of claim 1.

BRIEF DESCRIPTION OF THE DRAWINGS

The invention is explained in detail hereinafter using the drawings.

DETAILED DESCRIPTION

Figure 1:
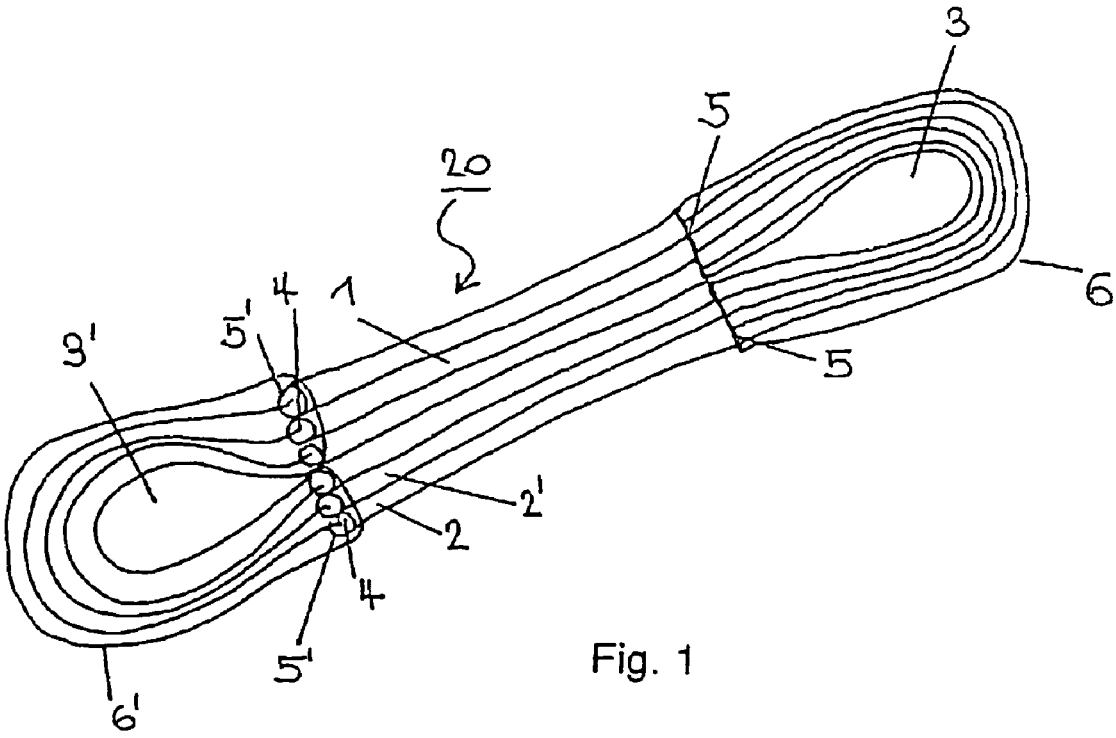
FIG. 1 shows a view of a lifting belt according to the invention.

FIG. 1 shows a view of a lifting belt sling according to the invention. The lifting belt sling consists of a tube-like structure 20 which has at least two chambers 2, 2' and thus forms a chamber tube 1 which is bounded by ends 5, 5'. The chambers are formed in the production process and consist of synthetic yarns, woven fabrics, knitted fabrics, cast plastic, extruded synthetic material, steel fabrics or chemically resistant material, leather or synthetic leather. In the at least two chambers are inlays which run endlessly from one side to the other side, or from one end 5 to the other end 5', through the chamber tube 1.

The inlays 4 consist of single fibers or fiber bundles of high-strength materials such as polyester (PES), polyamide (PA), polypropylene (PP), polyethylene (PE), Dyneema, Kevlar and steel strands. They are also termed tension inlays, since they take up substantially the whole load, while the chamber tube 1 surrounding them remains substantially unloaded under tension and above all exerts a protective function. A substantially longer life thus results for the lifting belt sling. The inlays and the protective tube can likewise consist of a combination of these materials, or of a mixed bundle of inlay fibers may be present.

The inlays 4 project beyond or overlap the ends 5, 5' of the chamber tube 1, so that loops 3, 3' are formed there. The inlays are covered in the loop region by a loop protection 6, 6', which as a rule overlaps the chamber tube 1 and is connected thereto. It can, however, abut on the ends 5, 5' of the chamber tube 1 without being connected (not shown). The chamber tube can consist of, be covered with, or be coated with different materials. Polyurethane, synthetic rubber, natural rubber, PVC, textile materials, bonded fibers, synthetic leather, leather, steel strand fabrics, woven yarn fabrics, and knitted yarn fabrics are concerned as materials. The inlays 4 introduced into the chamber tube 1 and endlessly passed back through the chamber tube form a band with endless inlays with the loops 3, 3' formed at both ends 5, 5'. The loops can be covered with various protective materials, e.g. as fabric or tube.

Figure 2:
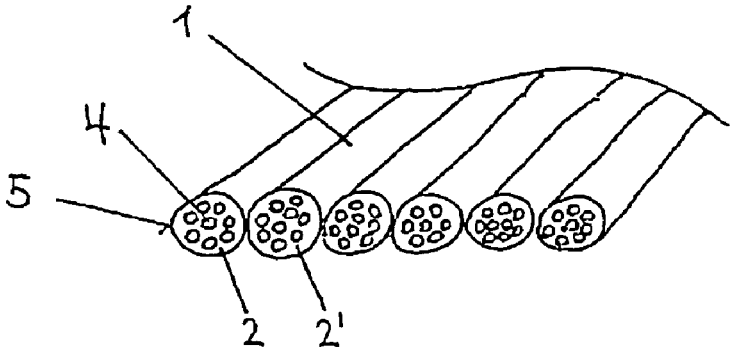
FIG. 2 is a perspective sectional view of a lifting belt sling.

FIG. 2 shows a perspective sectional view of a lifting belt sling. The chamber tube 1 can be seen with its one end 5 and the chambers 2, 2', in a line with which are four further chambers. The inlays 4 are located in the chambers. The at least two chambers 2, 2' are formed by sewing, knitting or weaving. Thus the chambers have, for example, seams lying in the tension direction parallel to the inlays, whereby the chamber tube is present, divided into chambers. Such lifting belt slings are predominantly used for applications in the machine industry, in the building trade, and for the transportation and goods industries, as is the case of goods packaging locations of all kinds.

Figure 3:
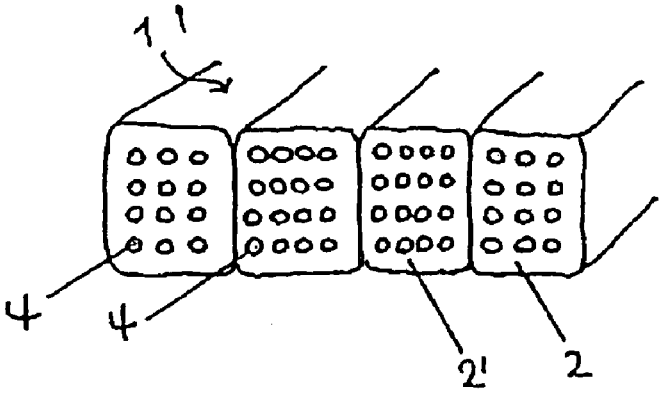
FIG. 3 is a perspective sectional view of a lifting belt sling with chambers of small width and large thickness.

FIG. 3 shows a perspective sectional view of a lifting belt sling with chambers of small width and great thickness. The tension inlays 4 are arranged in the chambers 2, 2' of the chamber tube 1, so that the chambers have a small width with a great thickness.

These belts are suitable above all for lifting large loads and are produced for loads of up to 100 t with a safety factor of 7:1. Such lifting belt slings find application in turbine building, for heavy loads in power plants, or in industry in general.

Figure 4:
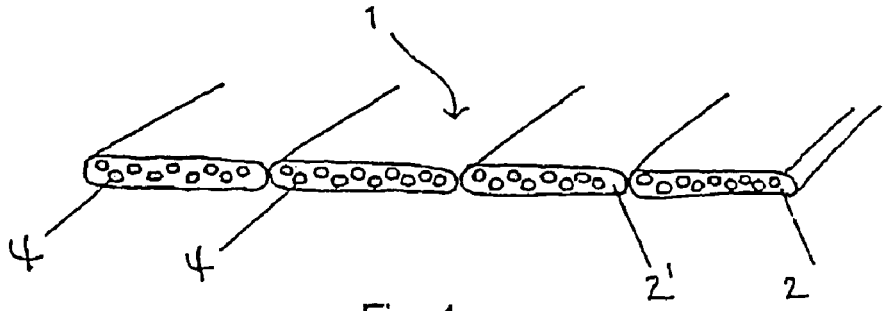
FIG. 4 is a perspective sectional view of a lifting belt sling with chambers of large width and small thickness.

FIG. 4 shows a perspective sectional view of a lifting belt sling with chambers of large width and small thickness. The tension inlays 4 are arranged in the chambers 2, 2' of the chamber tube 1 such that the chambers have a large width and a small thickness. Such lifting belt slings above all come into use when little space is available to push the lifting belt sling under the load. The chamber tube can thus have a cross section which is freely designed as regards thickness, width and inertia according to the use requirements.

Figure 4A:
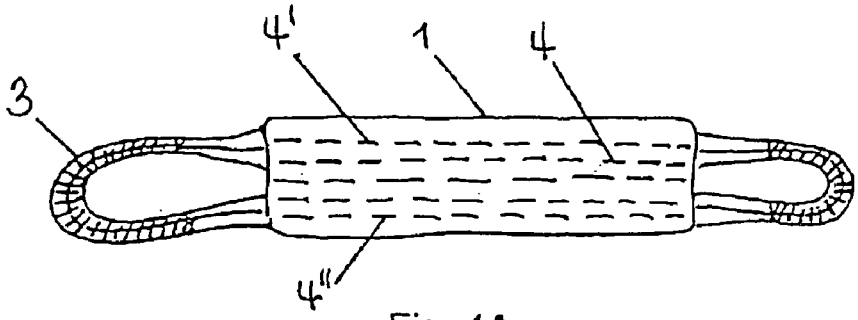
FIG. 4A shows a lifting belt sling with symmetrical inlays.

FIG. 4A shows a lifting belt sling with symmetrical inlays. The inlays 4 loosely inlaid into the chamber tube 1 are shown dashed here. The inlay 4' in the outer chamber of the one side of the chamber tube is conducted over the loop 3 and then conducted back as inlay 4" into the outer chamber of the other side of the chamber tube. The inlays 4 and 4' are thus located symmetrically with respect to a midline of the chamber tube. All further inlays are likewise arranged symmetrically with respect to this midline. This arrangement is termed "symmetric inlays."

When the chamber tube now has very many adjacent chambers, it can "fold together" under a tensile force, i.e. it is deformed U-shaped.

Figure 4B:
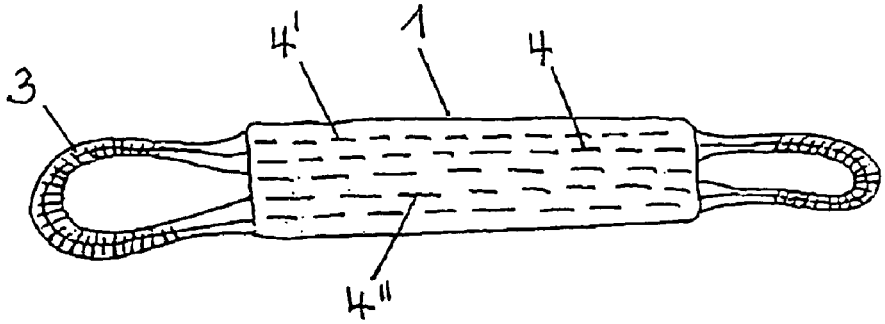
FIG. 4B shows a lifting belt sling with asymmetrical inlays.

FIG. 4B shows a lifting belt sling with asymmetrical inlays. The inlays 4 loosely inlaid into the chamber tube 1 are shown dashed here. The inlay 4' in the outer chamber of the one side of the chamber tube is conducted over the loop 3 and then conducted back as inlay 4" into an inner chamber of the other half of the chamber tube. The inlays 4 and 4' are thus located asymmetrically with respect to a midline of the chamber tube. All further inlays are likewise arranged asymmetrically with respect to this midline. This arrangement is termed "asymmetric inlays."

When the chamber tube now has very many adjacent chambers, it can hardly "fold together" any more under a tensile force, since because of the asymmetrical arrangement a transverse component of the tensile force opposes the deformation.

Figure 5:
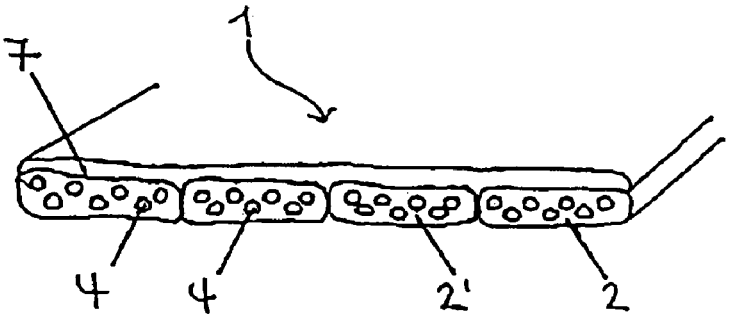
FIG. 5 shows a chamber tube with coating applied to one side.

FIG. 5 shows a chamber tube with coating applied on one side. The chamber tube 1 with the chambers 2, 2' and inlays 4 is provided with a coating 7 on one side.

The chamber tube can have a coating applied on one side or two sides. It can, however, also be produced as consisting of a material which is woven, knitted, extruded or cast, as an all-around coating. The coatings can be cast, injection molded, calendered, powder coated, or applied by doctor blade, and as a solution thereafter hardened. The chamber tube can have a coating which consists of the same materials or as different materials than the chamber tube.

Figure 6:
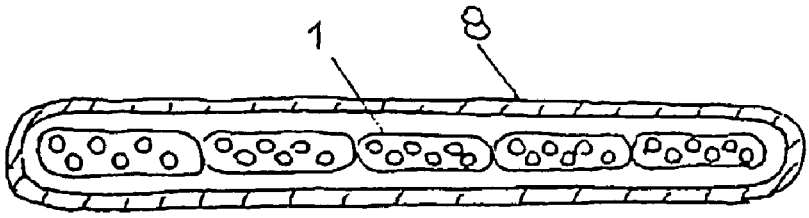
FIG. 6 shows a chamber tube with a surrounding protective tube.

FIG. 6 shows a chamber tube with a surrounding protective tube. The chamber tube 1 is surrounded by a protective tube 8. Plural protective tubes can be present, one over another. The protective tube can consist of natural or synthetic materials, of woven fabric, of knitted fabric, or as an extruded, cast element. The protective tube is arranged over the whole length of the chamber tube or only a portion thereof, or it can be made of several portions. The protective tube simultaneously acts as an abutment surface of the work goods and is therefore made of different materials according to the use requirements. According to the use, it is especially flame resistant, flame retardant, or resistant to heat, chemicals, cutting and abrasion. It has a jacket of woven or knitted material or a double jacket, which in particular is resistant to chemicals and consists of polyamide (PA), polypropylene (PP), polyester (PES), or polyethylene (PE), or a mixed fabric of these materials. As a rule it is manufactured of cut protection material which is highly resistant to cutting, and by means of special kinds of weave has an extremely high edge strength, since the edges are not under tensile stress. Particularly heat-resistant and flame-retardant embodiments are of Kevlar, steel strands, Nomex or a combination thereof. Extremely high abrasion resistance, cut strength and edge strength are attained.

The chamber tube 1, the inlays 4, the coating 7, the protective tube 8 and the edge protection can have the same or different materials.

The protective tube as well as the chamber tube can consist of extruded or cast synthetic materials. PVC, PU, rubber or synthetic rubber, a rubber mixture, natural or synthetic leather, woven or knitted steel strands, woven yarn or knitted yarn fabrics, which are coated on one side, both sides, or all around, are concerned.

According to the valid CE standards, the chamber tube, the protective tube, the protective coating, the inlays and the edge protection can have different materials.

CE Standard EN 1492-1 defines the lifting belt with prescriptions which are fully adhered to by the arrangement and combination of the stated materials.

Figure 7:
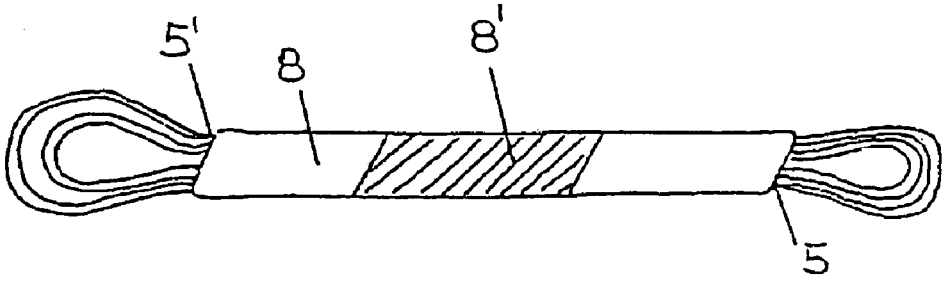
FIG. 7 shows a lifting belt sling with two protective tubes.

FIG. 7 shows a lifting belt sling with two protective tubes. The chamber tube is present here, surrounded by a first protective tube 8, so that it is covered from end 5 to end 5'. A second protective tube 8' is installed over the middle portion of the first protective tube 8, so that additional protection is guaranteed in this portion. The chamber tube can thus be covered with plural like or different protective tubes which by means of their position or distribution permit a reinforcement profile and a protection profile to exist over the whole length of the chamber tube, correct for the desired requirements.

A few embodiment examples are explained hereinafter.

Figure 8:
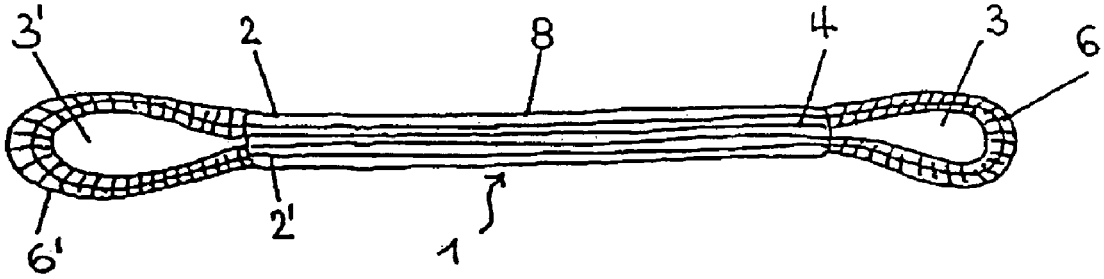
FIG. 8 shows a first embodiment example of a lifting belt sling with loops of different length.

FIG. 8 shows a first embodiment example of a lifting belt sling with loops of different lengths. The loops 3, 3' are here made of different lengths, so that they can be used optimally in respective applications. In this way, for example, the one loop of the lifting belt sling can be longer than the other for reasons of space with a different accessibility of the load. The lifting belt sling has a chamber tube 1 of 4 m and loops of different lengths of 0.8 m and 1.8 m, which gives a total length of 6.6 m. It is designed for a load of 100 t. The chamber tube is divided into 14 chambers 2, 2', in which inlays 4 of polyester strands are loosely inlaid. The chamber tube consists of polyester fabric and is covered with a protective tube 8 of polyester fabric coated with polyurethane which covers the whole chamber tube. The two loops 3, 3' have a loop protection 6, 6' of polyamide fabric and woven wide/narrow, the wide/narrow portion being located in the loop curvature.

Figure 9:
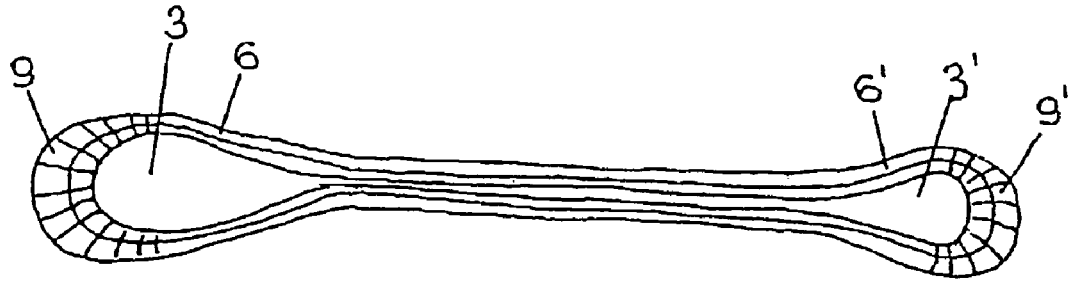
FIG. 9 shows a second embodiment example of a lifting belt sling with reinforced loop protection.
Figure 10:
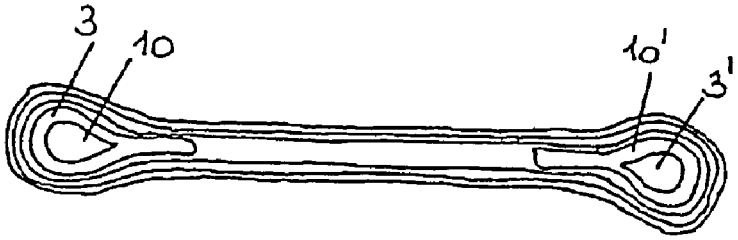
FIG. 10 shows a third embodiment example of a lifting belt sling with eyelets.
Figure 11:
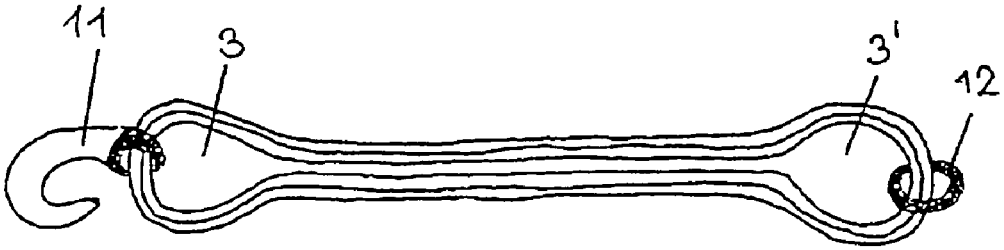
FIG. 11 shows a fourth embodiment example of a lifting belt sling with hooks and eyes.

FIGS. 9-11 show loops 3, 3' but do not show chamber tubes. It should be understood that a chamber tube is to be employed with the loops 3, 3' in FIGS. 9-11, as shown in FIG. 1, and that the loops 3, 3' are shown without a chamber tube merely for illustrative purposes.

FIG. 9 shows a second embodiment example of a lifting belt sling with reinforced loop protection. The loops 3, 3' are provided next to the loop protection 6, 6' with a reinforcement 9, 9' in the region of the curvature. This reinforcement consists of wide/narrow woven fabric, of extruded or cast synthetic material. The loops 3, 3' are as a rule surrounded with a wide/narrow woven loop protection. The loop protection 6, 6' consists of a synthetic or natural material, of leather, of synthetic leather, of polyurethane, PVC, or bonded fiber.

FIG. 10 shows a third embodiment example of a lifting belt sling with eyelets. Eyelets 10, 10' are here installed in the loops 3, 3'.

FIG. 11 shows a fourth embodiment example of a lifting belt sling with hooks and eyes, in which a hook 11 is installed in the one loop 3 and an eye 12 in the other loop 3'.

Figure 12:
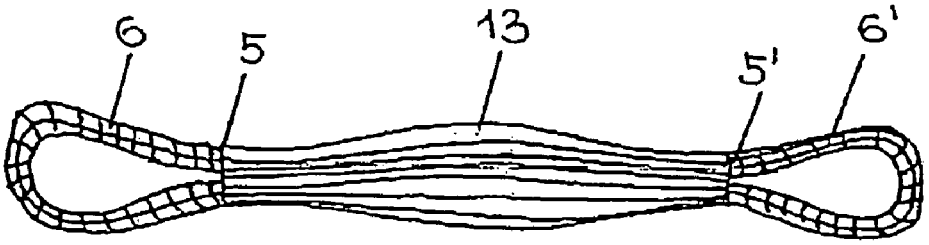
FIG. 12 shows a fifth embodiment example of a lifting belt sling with wide/narrow woven chamber tube, protective tube and loop protection.

FIG. 12 shows a fifth embodiment example of a lifting belt sling with a wide/narrow woven chamber tube, protective tube and loop protection. The chamber tube is here surrounded by a protective tube which is narrow-woven at the ends 5, 5', as is the chamber tube, while it is wide-woven in the middle 13. The loop protection 6, 6' is likewise woven wide/narrow, and in fact narrow in the middle, so that it has a small surface and fits into the load hooks. The lifting belt sling can thereby give the load a wide support on the load abutment surface and have a space-saving suspension in the loop region.

The invention claimed is:

1. A lifting sling for lifting loads, wherein the lifting belt sling comprises a tubular structure which has at least three chambers connected adjacent to one another; wherein at least one inlay is located in the at least three chambers and runs endlessly from one end of the at least three chambers to another end of the at least three chambers; wherein the at least one inlay stands out at the ends of the at least three chambers, so that loops are formed at the ends in a loop region; wherein the at least one inlay is covered by a loop protection in the loop region, and wherein the at least one inlay runs through each of the at least three chambers and is asymmetrically arranged, and wherein a single loop is provided at each end of the at least three chambers.

2. A lifting sling according to claim 1, wherein when the at least one inlay is under tension, the at least three chambers remain substantially unloaded.

3. A lifting sling according to claim 1, wherein the at least three chambers are surrounded by at least one protective tube, which extends over a portion thereof.

4. A lifting sling according to claim 3, wherein the at least one protective tube comprises extruded or cast synthetic material comprising PVC, PU, synthetic rubber or a rubber mixture.

5. A lifting sling according to claim 3, wherein the at least one protective tube has a woven double jacket which is resistant to chemicals and comprises polyamide (PA), polypropylene (PP), polyester (PES), or polyethylene (PE), or a mixed fabric of these materials.

6. A lifting sling according to claim 3, wherein the at least one protective tube comprises cut protection material which is highly resistant to cutting.

7. A lifting sling according to claim 3, wherein the at least one protective tube is heat resistant and flame retardant and comprises Kevlar, steel strands, Nomex or a combination thereof.

8. A lifting sling according to claim 3, wherein the at least one protective tube, by different kinds of weaves, has an extremely high abrasion resistance, cut strength, and edge strength.

9. A lifting sling according to claim 3, wherein the at least three chambers, the at least one protective tube, and the at least one inlay have the same materials.

10. A lifting sling according to claim 1, wherein the at least three chambers comprise cast or extruded synthetic material.

11. A lifting sling according to claim 1, wherein the at least three chambers comprise polyurethane, PVC, synthetic rubber, natural rubber, leather, synthetic leather, bonded fiber materials, textiles, woven steel or knitted steel or woven fabrics.

12. A lifting sling according to claim 1, wherein the at least three chambers have a coating which comprises the same materials as the at least two chambers.

13. A lifting sling according to claim 1, wherein the at least three chambers are coated on one side.

14. A lifting sling according to claim 1, wherein the at least three chambers are covered or coated with polyurethane, PVC, synthetic rubber, natural rubber, leather, synthetic leather, bonded fiber materials, textiles, woven steel or knitted steel or woven fabrics.

15. A lifting sling according to claim 1, wherein the at least three chambers have a cross section whose thickness, width and load limit are set according to use requirements

16. A lifting sling according to claim 1, wherein the at least three chambers are formed through sewing, knitting or weaving.

17. A lifting sling according to claim 1, wherein the at least three chambers have seams lying parallel to the at least one inlay in a tension direction and by which a chamber tube is divided into chambers.

18. A lifting sling according to claim 1, wherein the at least one inlay comprises high strength materials comprising polyester (PES), polyamide (PA), polypropylene (PP), polyethylene (PE), Dyneema, Kevlar, mixtures of these, or of steel strands.

19. A lifting sling according to claim 1, wherein the at least one inlay is present in the at least three chambers, the at least one inlay being arranged such that a large width and a small thickness or a small width and a large thickness results.

20. A lifting sling according to claim 1, wherein the at least one inlay is symmetrically arranged.

21. A lifting sling according to claim 1, wherein the at least one inlay is loosely inlaid.

22. A lifting sling according to claim 1, wherein the loops have the same length.

23. A lifting sling according to claim 1, wherein the loops are covered by protective material.

24. A lifting sling according to claim 1, wherein the loops have eyelets, hooks, or eyes.

25. A lifting sling according to claim 1, wherein the loops are surrounded by a woven loop protection.

26. A lifting sling according to claim 1, wherein the loops are covered with a woven fabric or tube.

27. A lifting sling according to claim 1, wherein the loop protection comprises a synthetic or natural material, of leather, of synthetic leather, of polyurethane, PVC, or bonded fiber.

28. A lifting sling according to claim 1, wherein it is designed for loads of up to 100 tons.

29. A lifting sling according to claim 1, wherein the at least three chambers are surrounded by at least one protective tube, which extends over the whole length of the at least three chambers.

30. A lifting sling according to claim 1, wherein the at least three chambers have a coating which comprises different materials as the at least three chambers.

31. A lifting sling according to claim 1, wherein the at least three chambers are coated on two sides.

32. A lifting sling according to claim 1, wherein the at least three chambers are coated all around.

33. A lifting sling according to claim 1, wherein the loops have a different length.

34. A lifting sling according to claim 1, wherein a single loop is provided at each end of the at least three chambers.

35. A lifting sling according to claim 1, wherein each chamber tube includes at least four chambers connected adjacent to one another; wherein at least one inlay is located in the at least four chambers and runs endlessly from one end of the at least four chambers to another end of the at least four chambers; wherein the at least one inlay stands out at the ends of the at least four chambers, so that loops are formed at the ends in a loop region; wherein the at least one inlay is covered by a loop protection in the loop region, and wherein the at least one inlay runs through the at least four chambers.

* * * * *